US006928749B2

(12) United States Patent
Park

(10) Patent No.: US 6,928,749 B2
(45) Date of Patent: Aug. 16, 2005

(54) LAUNDRY DRYER

(75) Inventor: Sang Ho Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/717,937

(22) Filed: Nov. 21, 2003

(65) Prior Publication Data

US 2004/0168343 A1 Sep. 2, 2004

(30) Foreign Application Priority Data

Nov. 26, 2002 (KR) ..... P2002-0073852

(51) Int. Cl.[7] ..... F26B 3/00
(52) U.S. Cl. ..... 34/491
(58) Field of Search ..... 34/491, 550, 553, 34/562, 595

(56) References Cited

U.S. PATENT DOCUMENTS 3,702,030 A * 11/1972 Janke ..... 34/498
4,385,452 A * 5/1983 Deschaaf et al. ..... 34/562
6,466,037 B1 * 10/2002 Meerpohl et al. ..... 324/695

FOREIGN PATENT DOCUMENTS

KR 1993-13343 7/1994

* cited by examiner

*Primary Examiner*—Kenneth Rinehart
(74) *Attorney, Agent, or Firm*—McKenna Long & Aldridge LLP

(57) ABSTRACT

A laundry drier determines an amount of laundry placed in the drier's drum and controls a dry pattern based on the amount of laundry. The laundry drier includes a rotatable drum having an interior for holding laundry; a moisture sensor, installed with respect to the interior of the rotatable drum, for measuring the water content of the laundry in the rotatable drum and outputting a value indicative of the water content; a voltage converter for converting the water content value output from the moisture sensor to a voltage and outputting a voltage signal; a pulse detector for outputting a pulse count generated from a contact count of the laundry coming into contact with the moisture sensor and outputting a pulsed signal indicative of the contact count; and a microcomputer for controlling the dry pattern based on the respective outputs of the voltage converter and the pulse detector.

5 Claims, 3 Drawing Sheets

LAUNDRY DRYER

This application claims the benefit of Korean Application No. 10-2002-0073852 filed on Nov. 26, 2002, which is hereby incorporated by reference.

BACKGROUND OF THE INVENTION

1. Field of the Invention

The present invention relates to a laundry drier, and more particularly, to a laundry drier provided with a pulse detector, employed in conjunction with a moisture sensor, to determine the amount of laundry put in the drier.

2. Discussion of the Related Art

In general, a laundry drier is an apparatus for drying wet objects, e.g., clothes, after completion of a washing cycle or the like. FIG. 1 illustrates such a laundry drier.

Referring to FIG. 1, a drum 2 for holding laundry is installed rotatably inside a cabinet 1 having a front side in which an entrance 3 is provided. A door 4 is installed in the entrance 3 so that laundry may be placed in the drum 2 via the entrance. A motor 5, installed in an upper space of the cabinet 1, is coupled to the drum 2 via a drum belt 6*a* such that the drum rotates when the motor is driven. As the drum 2 rotates, the laundry is stirred by a plurality of lifts 7 installed on an inner surface of the drum. Meanwhile, the motor 5 is differentially coupled, via a fan belt 6*b*, to a fan 9 installed in a space provided behind the drum 2. By thus driving the fan 9, hot air, heated by a heater 11, is circulated through a series of ducts. A circulation duct 8 is provided such that the space provided for the fan 9 communicates with a point near the entrance 3, with an external air supply duct 12 for supplying external air, and with a drain duct 13 for discharging condensed water generated from the circulating hot air.

In the operation of a laundry drier constructed as above, with wet laundry placed in the drum 2, the laundry drier is actuated to drive the motor 5 and thereby rotate the drum, so that the laundry is pulled upward by the lifts 7 to fall back down and be gently mixed. Meanwhile, the driving force of the motor 5 is also transferred to the fan 9, thus circulating the air in the circulation duct 8. The circulating air is heated by the heater 11, and the heated air is supplied to the drum 2 to evaporate the water content of the laundry. Air circulation continues as external air is supplied to the circulation duct 8 through the external air supply duct 12, to be mixed with the heated air in the circulation duct. The water content in the circulating air is condensed to be discharged through the drain duct 13.

The drying of laundry using a laundry drier as described above is typically performed by a controlling apparatus such as that illustrated in FIG. 2.

Referring to FIG. 2, a laundry drier according to a related art is comprised of a moisture sensor 20, installed with respect to the interior of a rotatable drum as described above, for sensing the water content of laundry in the drum to determine the drying status of the laundry and outputting a value indicative of the water content; a voltage converter 30 for converting the water content value to a voltage and outputting a voltage signal; a microcomputer 40 for outputting a control signal to control a drying pattern based on the voltage signal output of the voltage converter; and a load driver 50 for respectively driving a motor 60 and a heater 70 according to the control signal output from the microcomputer. The water content value varies according to the drying status of the laundry, and the variation is represented by the voltage output from the voltage converter 30 and input to the microcomputer 40. The microcomputer 40 thus determines the laundry's drying status by reading the input voltage and thereby monitoring the water content as the laundry dries, to control the dry pattern accordingly.

The above laundry drier according to the related art controls the dry pattern based on water content alone, regardless of the amount of laundry placed in the drier. Here, the dry pattern is the cycle by which the drum, heater, and exhaust fan are controlled, and an optimum dry pattern is desirable. The amount of laundry, however, affects the optimum dry pattern. Thus, the laundry drier of the related art produces poor drying results.

SUMMARY OF THE INVENTION

Accordingly, the present invention is directed to a laundry drier that substantially obviates one or more of the problems due to limitations and disadvantages of the related art.

An object of the present invention, which has been devised to solve the foregoing problem, lies in providing a laundry drier, by which the dry pattern is controlled based on an amount of laundry using a pulse signal generated from a count of contacts between a moisture sensor and the laundry.

It is another object of the present invention to provide a laundry drier in which an optimum drying pattern is achieved.

It is another object of the present invention to provide a laundry drier that improves drying performance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry drier comprising a rotatable drum having an interior for holding laundry; a moisture sensor, installed with respect to the interior of the rotatable drum, for measuring water content in the laundry in the rotatable drum and outputting a value indicative of the water content; means for converting the water content value output from the moisture sensor to a voltage and outputting a voltage signal; a pulse detector for outputting a pulse count generated from a contact count of the laundry coming into contact with the moisture sensor and outputting a pulsed signal indicative of the contact count; and a microcomputer for controlling a dry pattern based on the respective outputs of the converting means and the pulse detector.

The laundry drier according to the present invention uses the principle that a moisture sensor, for measuring the water content of laundry in a rotating drum holding an amount of laundry, inherently comes into intermittent contact with the laundry. The frequency of such contact is indicative of the amount of laundry in the drum.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiment of the present invention, examples of which are illustrated in the accompanying drawings.

Figure 1:
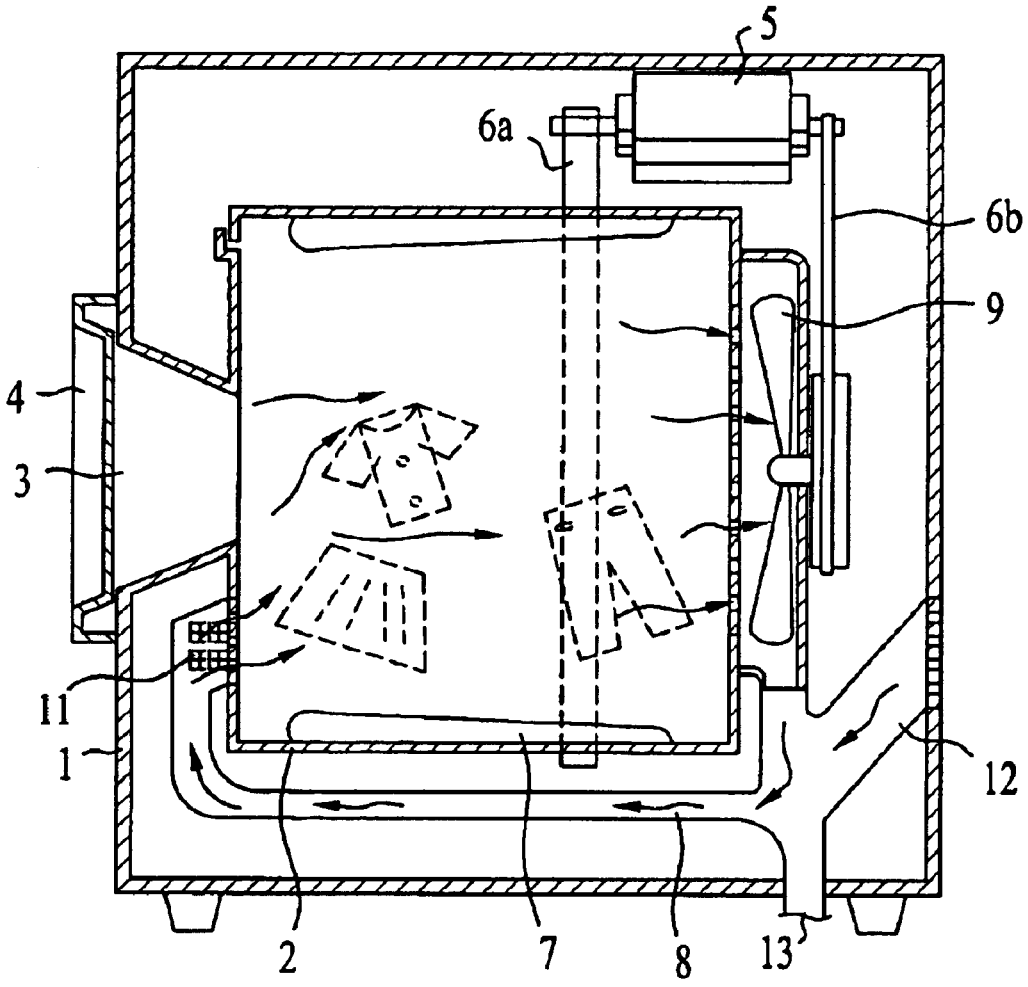
FIG. 1 Related Art
FIG. 1 is a cross-sectional view of a general drier.
Figure 2:
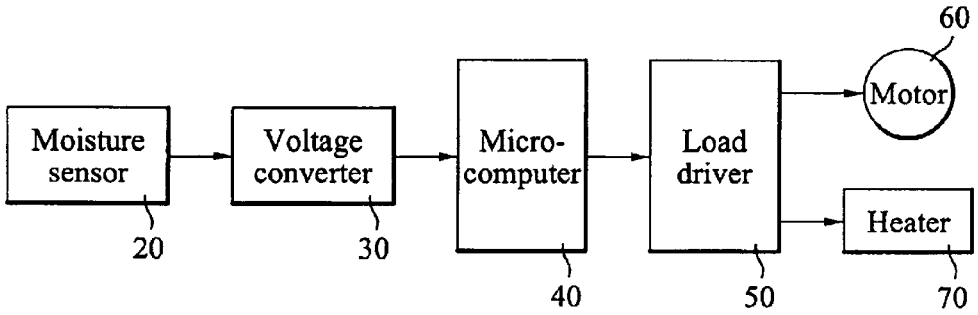
FIG. 2 Related Art
FIG. 2 is a block diagram of a control system of a laundry drier according to a related art.
Figure 3:
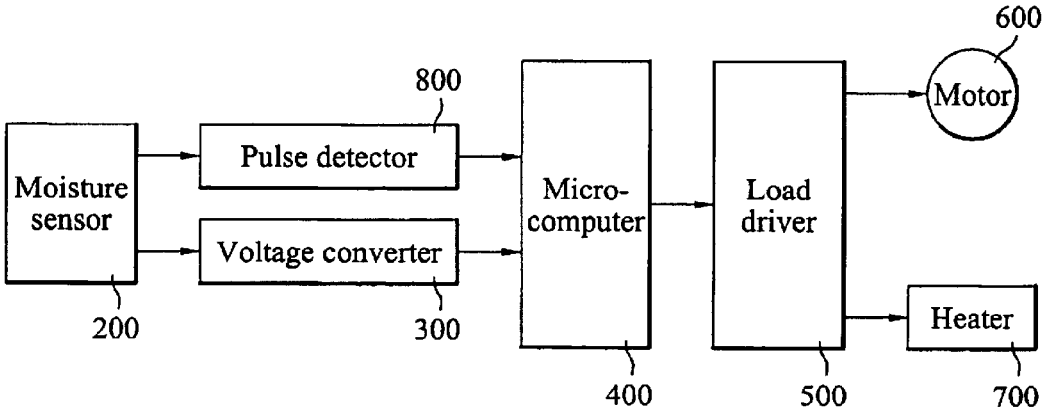
FIG. 3 is a block diagram of a control system of a laundry drier according to the present invention.

Referring to FIG. 3, a laundry drier according to the present invention is comprised of a moisture sensor 200, installed with respect to the interior of a rotatable drum as described above, for measuring the water content of laundry in the drum to determine the drying status of the laundry and outputting a value indicative of the water content; a voltage converter 300 for converting the water content value to a voltage and outputting a voltage is signal; a pulse detector 800 for detecting pulses according to a contact count of the laundry coming into contact with the moisture sensor and generating a pulsed signal indicative of the count; a microcomputer 400 for outputting a control signal to control a drying pattern based on the voltage signal output of the voltage converter; and a load driver 500 for respectively driving a motor 600 and a heater 700 according to the control signal output from the microcomputer.

Figure 4A:
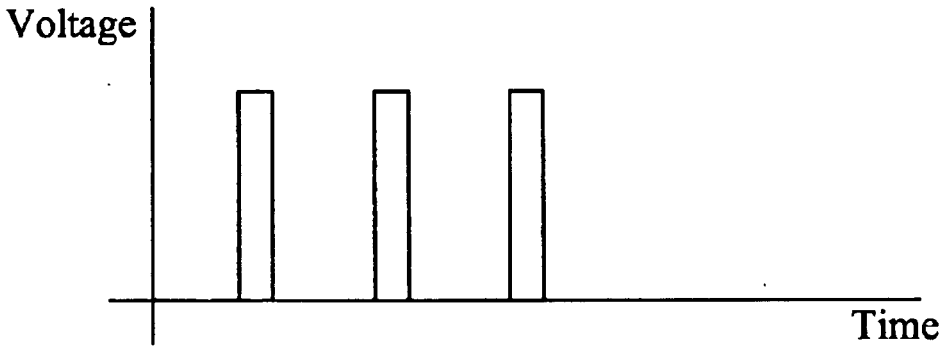
FIG. 4A and FIG. 4B are graphs of sample waveforms produced by the pulse detector in FIG. 3.
Figure 4B:
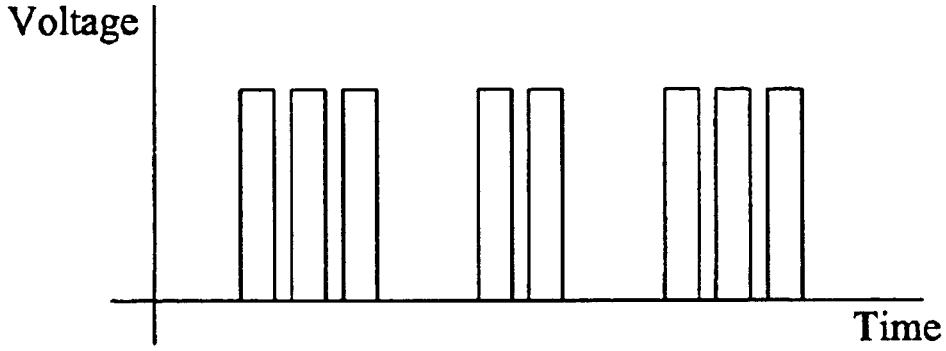

In the laundry drier according to the present invention, once a drying step is executed and the drum is rotated, the laundry in the drum is brought into contact with the moisture sensor 200 and thereby generates a voltage pulse for each contact. The pulse detector 800 counts the voltage pulses. Samples of such a count are illustrated in FIGS. 4A and 4B.

During the rotation of the drum, whenever the laundry comes into contact with the moisture sensor 200, each generated voltage pulse is input to the microcomputer 400 through the pulse detector 800. If the amount of the laundry in the drum is small, the generated voltage pulses have a relatively long interval as shown in FIG. 4A, and the microcomputer 400 determines the laundry amount to be small. On the other hand, if the amount of the laundry in the drum is large, the generated voltage pulses have a relatively short interval as shown in FIG. 4, and the microcomputer 400 determines the laundry amount to be large. The microcomputer 400 respectively controls the drive times of the motor 600 and heater 700 accordingly, whereby drive time is increased for larger amounts and decreased for smaller amounts.

Therefore, the laundry drier according to the present invention controls the dry pattern based on both the amount of laundry and its water content, thereby achieving an optimum dry pattern to improve drying performance.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer comprising:

a rotatable drum having an interior for holding laundry;

a moisture sensor, installed with respect to the interior of said rotatable drum, for measuring water content of the laundry in said rotatable drum and outputting a value indicative of the water content;

means for generating a voltage signal based on the water content signal where the amplitude of the voltage signal is dependent on water content, wherein the means converts the amplitude of the water content value output from said moisture sensor to a voltage and outputs a voltage signal;

a pulse detector for determining a contact count based on the water content signal and outputting a pulse count generated from a contact count of the laundry coming into contact with said moisture sensor wherein the pulse count is indicative of the contact count; and a microcomputer for controlling a drying cycle based on the pulse count and the voltage signal.

2. The laundry dryer as claimed in claim 1, wherein the pulse count output from said pulse detector is directly indicative of an amount of laundry in said rotatable drum.

3. The laundry dryer as claimed in claim 2, wherein the drying cycle is determined by the amount of laundry in said rotatable drum.

4. The laundry dryer as claimed in claim 1, further comprising a heater for heating air in said rotatable drum and motor for rotating said rotatable drum, said heater and motor being driven according to the drying cycle, wherein said microcomputer drives said heater and motor based on the pulse count output from said pulse detector.

5. The laundry dryer as claimed in claim 1, wherein said converting means is a voltage converter connected between said moisture sensor and said microcomputer.

* * * * *